US005803068A

United States Patent [19]

Summers

[11] Patent Number: 5,803,068

[45] Date of Patent: Sep. 8, 1998

[54] NO TORQUE ROPE RELEASE

[76] Inventor: Gregory E. Summers, 105 Overlink Ct., Lynchburg, Va. 24503

[21] Appl. No.: 786,038

[22] Filed: Jan. 21, 1997

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 2,417,791 | 3/1947 | Tyzkiewicz . | |
| 2,488,597 | 11/1949 | Konold . | |
| 2,637,311 | 5/1953 | Rose . | |
| 2,777,437 | 1/1957 | Allen . | |
| 2,819,707 | 1/1958 | Kayfes et al. . | |
| 2,905,166 | 9/1959 | Niemeyer . | |
| 2,965,093 | 12/1960 | Arsenault . | |
| 2,977,952 | 4/1961 | Gabriel . | |
| 3,768,456 | 10/1973 | Hansen et al. | 124/35.2 |
| 3,847,133 | 11/1974 | Awiszus . | |
| 3,853,111 | 12/1974 | Stanislawski et al. | 124/35.2 |
| 3,965,884 | 6/1976 | Killian | 124/35.2 |
| 4,086,904 | 5/1978 | Suski et al. | 124/90 |
| 4,134,369 | 1/1979 | Cook | 124/35.2 |
| 4,151,825 | 5/1979 | Cook | 124/35.2 |
| 4,282,851 | 8/1981 | Lyons | 124/35.2 |
| 4,509,497 | 4/1985 | Garvison | 124/35.2 |
| 4,539,968 | 9/1985 | Garvison | 124/35.2 |
| 4,620,523 | 11/1986 | Peck | 124/35.2 |
| 4,656,994 | 4/1987 | Jenks . | |
| 4,665,886 | 5/1987 | Barlow | 124/35.2 |
| 4,674,469 | 6/1987 | Peck | 124/35.2 |
| 4,691,683 | 9/1987 | Peck | 124/35.2 |
| 4,722,319 | 2/1988 | Brady | 124/35.2 |
| 4,791,908 | 12/1988 | Pellis | 124/35.2 |
| 4,881,516 | 11/1989 | Peck | 124/35.2 |
| 4,909,233 | 3/1990 | Stephenson | 124/91 |
| 4,926,835 | 5/1990 | Peck | 124/35.2 |
| 4,930,485 | 6/1990 | Kopper | 124/91 |
| 4,981,128 | 1/1991 | Garvison | 124/35.2 |
| 5,016,603 | 5/1991 | Tentler | 124/91 |
| 5,020,508 | 6/1991 | Greene, Jr. | 124/35.2 |
| 5,027,786 | 7/1991 | Peck | 124/35.2 |
| 5,070,854 | 12/1991 | Peck | 124/35.2 |
| 5,076,251 | 12/1991 | Peck | 124/35.2 |
| 5,078,116 | 1/1992 | Peck | 124/35.2 |
| 5,103,796 | 4/1992 | Peck | 124/35.2 |
| 5,170,771 | 12/1992 | Peck | 124/35.2 |
| 5,170,772 | 12/1992 | Hamm | 124/35.2 |
| 5,247,921 | 9/1993 | Todd | 124/35.2 |
| 5,263,466 | 11/1993 | Peck | 124/35.2 |
| 5,287,842 | 2/1994 | Saunders | 124/91 |
| 5,318,004 | 6/1994 | Peck | 124/35.2 |
| 5,359,983 | 11/1994 | Peck | 124/35.2 |
| 5,361,747 | 11/1994 | Laabs | 124/91 |
| 5,370,102 | 12/1994 | Peck | 124/35.2 |
| 5,390,657 | 2/1995 | Larson | 124/91 |
| 5,582,158 | 12/1996 | Linsmeyer | 124/35.2 |
| 5,596,977 | 1/1997 | Scott | 124/35.2 |

*Primary Examiner*—John A. Ricci
*Attorney, Agent, or Firm*—Nixon & Vanderhye P.C.

[57] ABSTRACT

A rope release device includes a housing having a first fixed jaw and a second jaw movable toward and away from the fixed jaw. A length of rope is secured to the housing and includes a closed loop adapted to be engaged between the first fixed jaw and the second movable jaw. A handle supports the housing for rotational adjustment of the housing relative to the handle to eliminate rope torque at full draw.

13 Claims, 4 Drawing Sheets

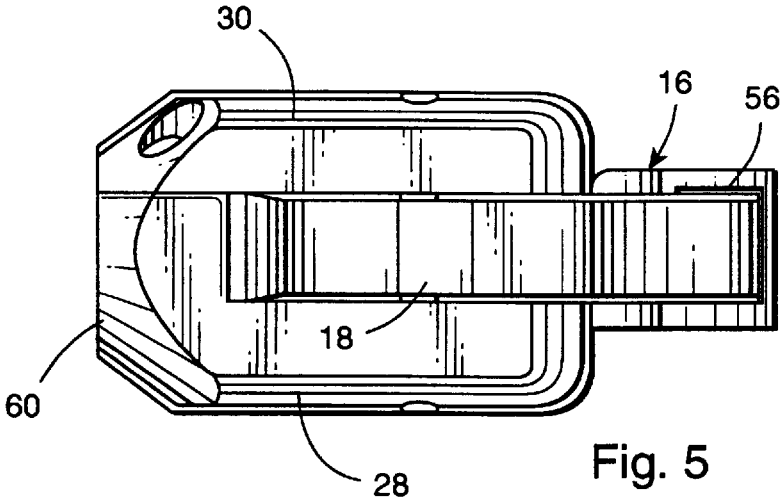
Fig. 5
Fig. 6
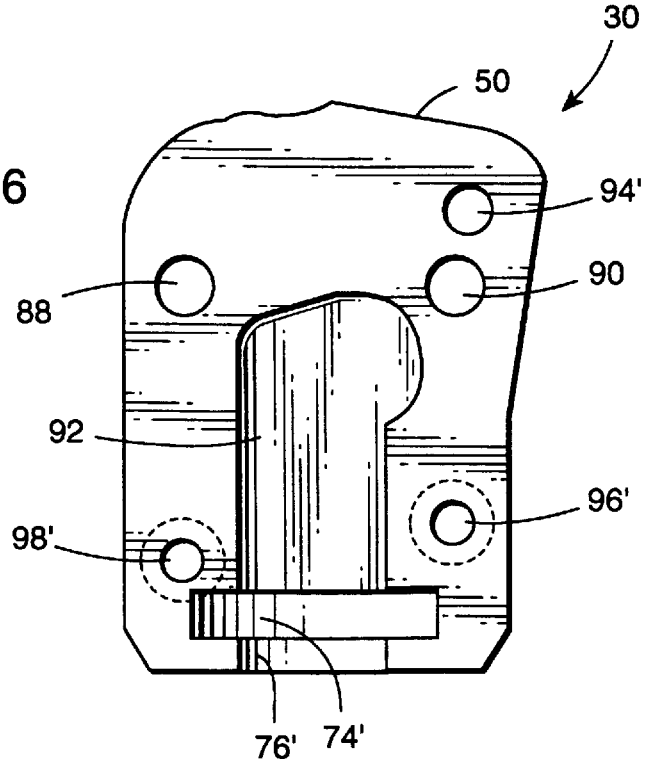
Fig. 7
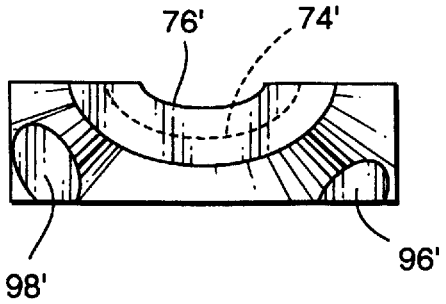

NO TORQUE ROPE RELEASE

This invention relates to a bowstring release and, more specifically, to a mechanical gripper rope release.

BACKGROUND AND SUMMARY OF THE INVENTION

Various release devices are utilized in archery to assist the archer in pulling a bowstring to a fully drawn position and then releasing the bowstring to fire the arrow. Many of these devices include mechanical grippers which engage the bowstring directly, or which engage nock elements mounted on the bowstring. Other devices use rope looped about the bowstring as the release mechanism. In release devices of the latter kind, the looped rope is often subject to a twisting action as the archer draws the bowstring to a fully drawn position due to a cocking or turning action of the archer's wrist. This kind of twist or torque applied to the release rope can result in reduced arrow speed and accuracy.

It is the principal object of this invention to provide a mechanical gripper type rope release device which eliminates torque at full draw. More specifically, a rope release is provided which includes fixed and movable jaws mounted in a housing, which are used to hold a closed loop portion of a release rope which has been wrapped about the bowstring. The release rope is secured to the fixed jaw, permitting easy manipulation of the closed loop about the bowstring and into the jaw area of the release.

A T-shaped handle incorporating a trigger mechanism supports the jaw housing, and the handle is rotatably adjustable relative to the handle. In this way, the archer can pre-adjust the jaw housing to accommodate any normal twist applied by the archer during the drawing action. The adjustment is made so that any normally applied twist is fully "unwound" at full draw, thus eliminating torque on the release rope which otherwise negatively impacts both arrow speed and accuracy.

The trigger mechanism illustrated herein incorporates firing pin and ball actuator of the type disclosed in commonly owned co-pending application Ser. No. 08/395,435 filed Feb. 28, 1995, now U.S. Pat. No. 5,680,851 issued Oct. 28, 1997 and 08/422,537 filed Apr. 14, 1995, now U.S. Pat. No. 5,685,286 issued Nov. 11, 1997, but the invention here is not limited to any such trigger mechanism. Similarly, the handle construction disclosed herein is illustrative only, except for the manner in which the jaw housing is mounted to the handle for rotational adjustment. To achieve this adjustability feature, the jaw housing is formed in two parts, each part formed at its rearward end with machined recesses which, when the parts are assembled, form a relatively small diameter bore and an adjacent, larger diameter annular groove. The handle includes a forwardly directed post, the forward end of which is formed with a smaller diameter neck and a larger disk-like head or bearing. Upon assembly, the smaller diameter neck fits within the smaller diameter bore and the larger disk-like bearing fits within the larger diameter annular groove. With the housing parts assembled about the post end of the handle, but with fastening screws extending between the housing parts not fully tightened, the jaw housing can be rotated about the disk-like bearing to the desired degree. Once proper rotational orientation is achieved, the fastener screws are tightened, thus clamping the disk-like bearing between the cooperating housing parts, preventing further relative rotation.

With further regard to the housing, a movable jaw is pivotally mounted between the housing parts for rotation between open and closed positions relative to a fixed jaw formed integrally with one of the housing parts. The movable jaw is provided with a transversely oriented spring retention hook which provides a forward abutment for a coil spring. The other end of the spring bears on an actuator ball movable axially in forward and rearward directions adjacent the rearward end of the movable jaw. A spring biased firing pin operatively connected to the trigger mechanism engages the ball on the side opposite the rearward end of the spring.

When the movable jaw is in the closed position, the coil spring biases the actuator ball rearwardly to a position where the ball is engaged by surfaces on the housing wall and on the rearward end of the movable jaw so that the latter is prevented from rotating to the open position. When the trigger mechanism is actuated to fire an arrow, the firing pin engages the ball actuator and moves it forwardly against the bias of the coil spring. As the ball actuator moves forwardly away from the aforementioned cooperating surfaces, it moves into a relieved area, freeing the movable jaw for rotation to the open position. This movement is enhanced by the compression of the coil spring by the ball actuator against the spring retention hook on the movable jaw which serves as a moment arm, urging the jaw about its pivot axis to the open position. As the jaw opens, the forward force of the bowstring pulls the rope release out of the jaws, thereby releasing the bowstring and the arrow.

Accordingly, in its broader aspects, the invention provides a rope release device comprising a housing including a first fixed jaw and a second jaw movable toward and away from the fixed jaw; a length of rope secured to the housing and including a closed loop adapted to be engaged between the first fixed jaw and the second movable jaw; and a handle supporting the housing for rotational adjustment of the housing relative to the handle.

Additional objects and advantages of the rope release in accordance with this invention will become apparent from the detailed description which follows.

BRIEF DESCRIPTION OF THE DRAWINGS

FIG. 5 is an end elevation of the housing portion of the release illustrated in FIG. 1;

FIG. 6 is a side elevation of the cap component of the housing illustrated in FIG. 1;

FIG. 7 is a front elevation of FIG. 6; and

DETAILED DESCRIPTION OF THE DRAWINGS

Figure 1:
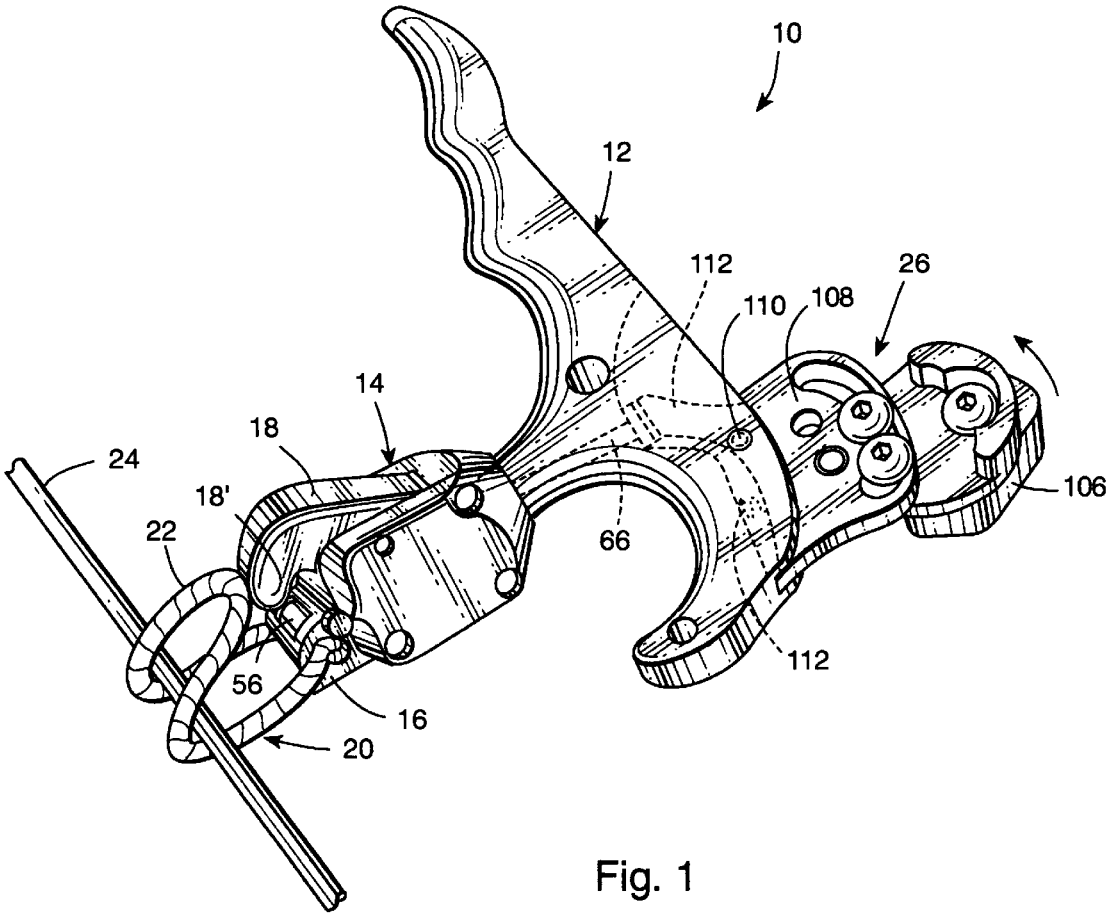
FIG. 1 is a perspective view of a rope release in accordance with an exemplary embodiment of the invention.
Figure 2:
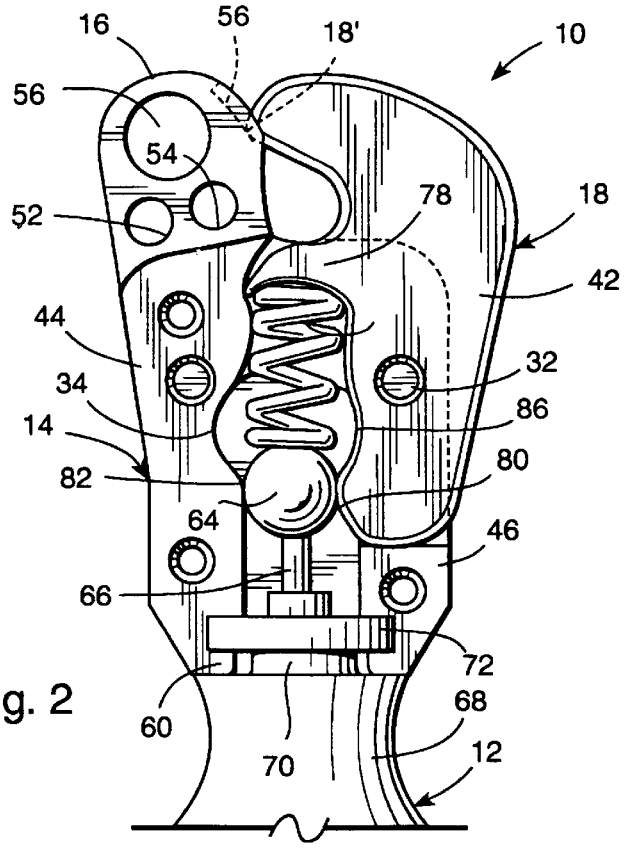
FIG. 2 is a side elevation of the jaw and housing portion of the release illustrated in FIG. 1, with a housing part removed to show the interior of the housing, and with a movable jaw in a closed position.
Figure 3:
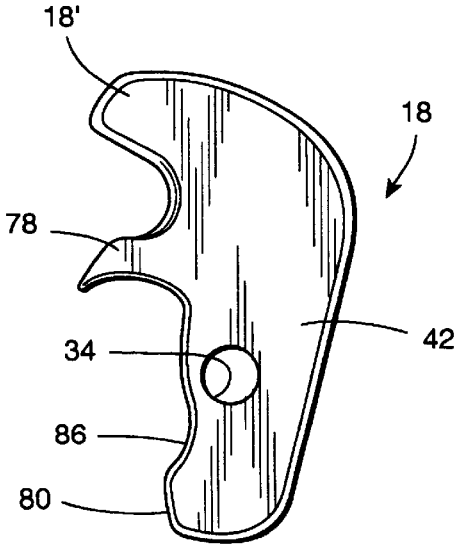
FIG. 3 is a side elevation of a movable jaw used in the release in accordance with the invention.
Figure 4:
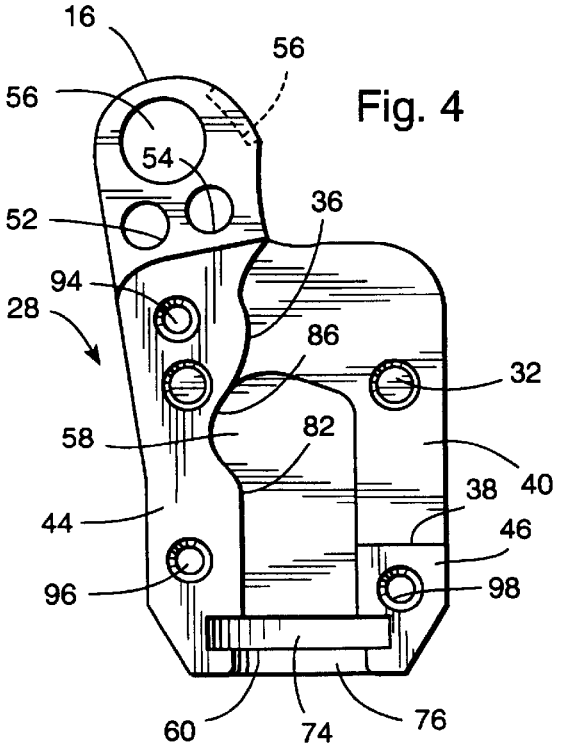
FIG. 4 is a side elevation of a housing base plate in accordance with the exemplary embodiment of the invention.

Generally and with particular reference to FIGS. 1 and 2, the release 10 comprises a generally T-shaped handle 12 and a release housing 14 which includes a fixed jaw 16 and which supports a movable jaw 18 for pivotal movement toward and away from the fixed jaw 16. A length of release rope 20 is secured at its free ends to the fixed jaw, forming a closed loop 22 which is adapted to be wrapped around a bowstring 24 and held between the jaws 16 and 18. At full draw, a thumb actuated trigger mechanism 26 is actuated to open the jaw 18 to release the loop 22 and hence the bowstring 24 (and arrow, not shown). The various components will be described in greater detail below.

With reference now also to FIGS. 3–7, the housing 14 includes two component parts, a base plate 28 and a cap 30, between which is supported the movable jaw 18. The latter is pivotally mounted on the plate 28 by a pivot pin 32 extending through a hole 34 in the jaw 18. The base plate 28 is formed with a recessed area extending between edge 36 and edge 38 on either side of the pin 32 to accommodate the jaw 18. Thus, when the jaw 18 is mounted in place as shown in FIG. 2, it rests on surface 40 of the plate while surface 42 of the jaw is flush with surfaces 44 and 46 of the base plate 28.

The fixed jaw 16 is raised out of the plane of surface 44, with an edge 48 abutting an edge 50 of the cap 30 when the latter is mounted in place, as further described below. Jaw 16 is also formed with three holes 52, 54 and 56, two of which (52, 54) are smaller in diameter and adjacent one another. These three holes are used to retain the release rope 20 as also described below. An inner side of the jaw 16 facing jaw 18 is formed with a shallow recess 56 for receiving a forwardmost portion 18' of the jaw 18 when the latter is closed, as best seen in FIG. 2.

The plate 28 is also formed with a centrally located and further recessed portion 58 extending forwardly from rearward end 60 of the housing 14. The space defined by the center recess 58 between raised surface 44 and the movable jaw 18 receives a coil spring 62 and a ball actuator 64 as best seen in FIG. 2. The ball actuator 64 is adapted to be engaged on its rearward side (diametrically opposite the coil spring 62) by a firing pin 66 extending forwardly of a hollow post portion 68 of the handle 12.

The post portion 68 of the handle 12 is formed with a reduced diameter neck 70 and an enlarged, annular head or bearing 72, through which the firing pin 66 extends. At the same time, the rearward end 60 of the housing 14 is formed with cooperating recesses 74, 74' and 76, 76' in parts 28, 30 which, when the parts 28 and 30 are assembled, receive and surround the neck 70 and bearing 72, respectively. It is this arrangement which allows the housing 14 to rotate relative to the handle 12 as described further below.

Figure 8:
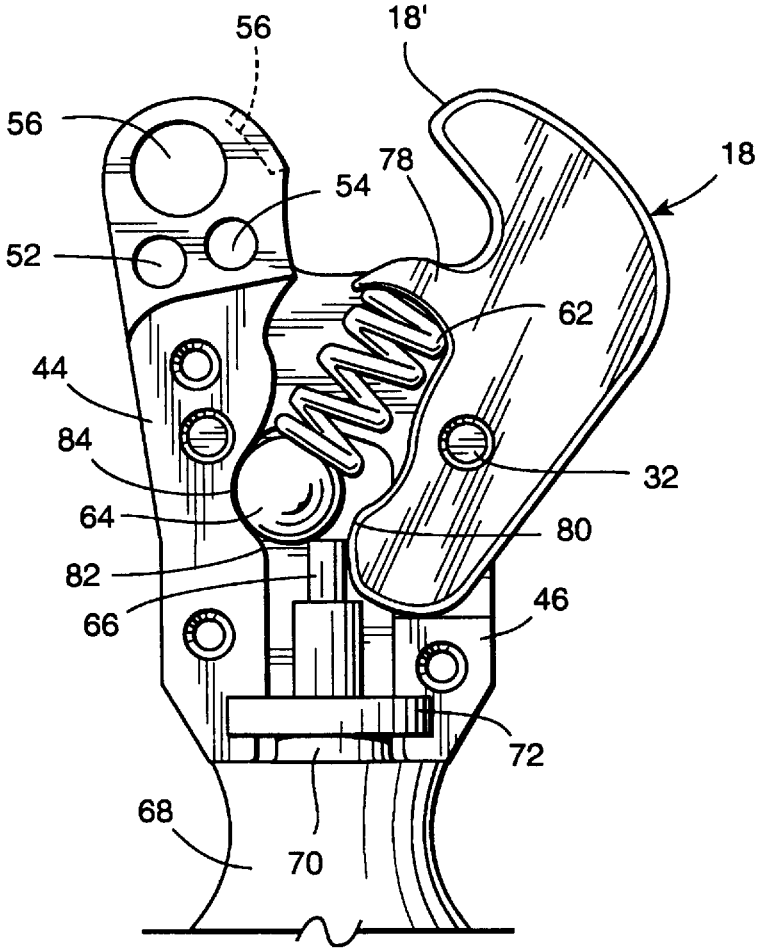
FIG. 8 is a side elevation similar to FIG. 1 but illustrating the movable jaw in the open position.

The movable jaw 18 is formed with a spring retention hook 78 which holds the forward end of spring 62 in place. The jaw 18 is also formed with a lateral projection 80 adjacent its rearward end which engages the ball 64 when the jaw 18 is closed. The opposite side of the ball 64 engages a surface 82 along an edge of the raised surface 44 in this same closed position. Both the jaw 18 and the plate 28 are formed with relief areas 84, 86, respectively, lying adjacent and forward of the projection 80 and surface 82. These relieved areas receive the ball 64 when the latter is initially moved forwardly by the firing pin 68. This movement of the ball actuator 64 away from projection 80 and surface 82 also allows the jaw 18 to pivot clockwise (as viewed in FIG. 2) about the pin 32 to the open position shown in FIG. 8, as further described below.

With specific reference to FIGS. 5–7, the cap component 30 is formed with a pair of holes 88, 90 which receive pins 32 and 32' extending from the base plate 28. This arrangement accurately locates the cap 30 over the plate 28 and jaw 18, with the cap seated on surfaces 44, 46 of the plate 28 and surface 42 of the jaw 18. Cap 30 is also formed on its inner side with a shallow recess 92 which cooperates with recess 58, and recesses 74', 76' which cooperate with recesses 74, 76 in the plate 28 as previously described. Three fastener holes 94, 96 and 98 in the plate 28 align with similar holes 94', 96' and 98' in the cap, with screws 100, 102 and 104 used to secure the cap 30 to the plate 28, thus completing assembly of the housing 14.

It will be appreciated that tightening of the screws 100, 102 and 104 clamps the plate 28 and cap 30 about the bearing 72, thereby precluding any rotational movement of the housing 14 relative to the handle 12. By slightly loosening the same screws, however, the housing (with jaws 16 and 18) can be rotated about the bearing 72 to a desired rotational position relative to the handle 12. In this way, the archer can pre-adjust the release device to accommodate the normal amount of wrist or hand twist which occurs during draw so that, at full draw, there is no twist or torque applied to the release rope 20.

Referring now again to FIG. 1, the trigger mechanism 26 includes a thumb grip 106 adjustably mounted on a base 108 pivotally mounted within the handle 12 by a pin 110. An offset portion 112 formed on the base 102 engages the rear end of the firing pin 66 so that slight counterclockwise rotation of the trigger mechanism 26 (as shown in FIG. 1), will drive the pin 66 forwardly to a release position as described below. A coil or other spring 112 may be employed to bias the firing pin 66 forwardly, but the force exerted by spring 62 is dominant.

The release rope 20 is secured to the jaw 16 in the following manner. One free end of the rope is threaded through one of the holes 52 and 54 and secured on one side of the fixed jaw 16 by enlarging and rigidifying the free end of the rope with glue or other suitable material. The rope is then passed through the larger hole 56 in one direction and the passed back through the larger hole after forming the loop 22. The remaining free end of the rope is then passed through the other of the smaller holes 52 and 54 and secured as described above. The closed loop 22 now extends forwardly of the device as shown in FIG. 1. As also shown in FIG. 1, the loop 22 may be doubled back about the bowstring 24 and engaged between the jaws 16, 18. With the release rope so placed, the jaw 18 is pinched closed by the archer. In closing the jaw 18, the spring 62 forces the ball actuator 64 rearwardly to the position shown in FIG. 1, between projection 80 and cooperating surface 82. Since the force exerted by spring 62 overcomes the forward bias of spring 112, the ball actuator 64 remains in place, and the jaw 18 remains closed, i.e., the jaw 18 cannot open with the ball as shown in FIG. 1.

After full draw, the archer presses the thumb trigger 26, advancing the firing pin 66 and pushing the ball actuator 64 forwardly, away from projection 80 and surface 82 and into the space between relief areas 84 and 86, thus allowing jaw 18 to open. The jaw opening action is enhanced by spring 62 pressing on the hook 78 which, in turn, urges the jaw to rotate in a clockwise direction about the pin 32 to the open position shown in FIG. 8. As the jaw opens, the forward end of the spring 62 remains within the retention hook, thus canting the rearward end of the spring, as well as the ball actuator 64, sideways, so that the ball actuator 64 is fully seated within the relief area 84. The jaw 18 will thus remain in the open position until pinched closed as described above.

For the various components of the housing and handle, CNC aluminum and stainless steel are preferred, but other materials may be suitable as well.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rope release device comprising:

a housing including a first fixed jaw and a second jaw movable toward and away from the fixed jaw;

a length of rope including a closed loop adapted to be engaged between the first fixed jaw and the second jaw; and a handle supporting said housing for rotational adjustment of said housing relative to said handle wherein said handle incorporates a trigger operatively connected to said second jaw.

2. The rope release of claim 1 wherein said housing includes a base plate on which said second jaw is pivotally mounted, and a cap which is secured to said base plate with said second jaw sandwiched therebetween.

3. A rope release device comprising:

a housing including a first fixed jaw and a second jaw movable toward and away from the fixed jaw;

a length of rope including a closed loop adapted to be engaged between the first fixed jaw and the second jaw; and a handle supporting said housing for rotational adjustment of said housing relative to said handle wherein said handle incorporates a trigger operatively connected to said second jaw; and wherein said housing includes a base plate on which said second movable jaw is pivotally mounted, and a cap which is secured to said base plate with said second jaw sandwiched therebetween; and further wherein said base plate and said cap are formed with cooperating grooves which receive an annular bearing on said handle, so that said housing can be rotated relative to said handle.

4. The rope release of claim 3 including a plurality of fasteners for securing said cap to said base plate such that, upon tightening of said fasteners, said base plate and cap are clamped to said bearing to thereby preclude relative rotation between said housing and said handle.

5. A rope release device comprising:

a housing including a first fixed jaw and a second jaw movable toward and away from the fixed jaw;

a length of rope including a closed loop adapted to be engaged between the first fixed jaw and the second jaw; and a handle supporting said housing for rotational adjustment of said housing relative to said handle wherein a firing pin extends forwardly of said handle into said housing, and further wherein a ball actuator is located in said housing forward of said firing pin.

6. The rope release of claim 5 wherein said second jaw is formed with a transverse spring retention hook, and wherein a coil spring is located between said spring retention hook and said ball actuator.

7. The rope release of claim 6 wherein said firing pin is spring biased in a forward firing direction, and said ball actuator is spring biased in a rearward direction.

8. The rope release of claim 7 wherein said second jaw and said base plate have surfaces engageable with said ball actuator when the second jaw is closed, and which prevent opening of the second jaw.

9. The rope release of claim 8 wherein at least one relief area is provided forward of said surfaces to receive the ball actuator when said ball actuator is moved forwardly by said firing pin, to thereby allow said second jaw to open.

10. A rope release device comprising:

a housing including a first fixed jaw and a second jaw movable toward and away from the fixed jaw;

a length of rope including a closed loop adapted to be engaged between the first fixed jaw and the second jaw; and a handle supporting said housing for rotational adjustment of said housing relative to said handle wherein said first fixed jaw has a recess therein which receives a forward end of said movable jaw in a closed position.

11. A rope release device comprising:

a housing including a first fixed jaw and a second jaw movable toward and away from the fixed jaw;

a length of rope secured to said first fixed jaw and including a closed loop adapted to be engaged between the first fixed jaw and the second jaw; and a trigger operatively connected to a firing pin extending into said housing, and further wherein a ball actuator is located in said housing forward of said firing pin.

12. A rope release device comprising:

a housing including a first fixed jaw and a second jaw movable toward and away from said first fixed jaw;

a length of rope secured to said first fixed jaw and including a closed loop adapted to be engaged between the first fixed jaw and the second jaw;

a trigger for moving said second jaw away from said first fixed jaw; wherein said first fixed jaw has a recess therein which receives a forward end of said second jaw in a closed position.

13. A rope release device comprising:

a housing including a first fixed jaw and a second jaw movable toward and away from the fixed jaw;

a length of rope secured to said first fixed jaw and including a closed loop adapted to be engaged between the first fixed jaw and the second jaw; said fixed jaw having plural holes therein for securing said length of rope; and a handle incorporating a trigger operatively connected to said second jaw.

* * * * *